US011371714B2

(12) United States Patent
Lee et al.

(10) Patent No.: US 11,371,714 B2
(45) Date of Patent: Jun. 28, 2022

(54) COOKING APPLIANCE

(71) Applicant: LG ELECTRONICS INC., Seoul (KR)

(72) Inventors: Dae Yong Lee, Seoul (KR); Chung Kang, Seoul (KR); Daejin Jo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/170,021

(22) Filed: Feb. 8, 2021

(65) Prior Publication Data

US 2021/0262669 A1 Aug. 26, 2021

(30) Foreign Application Priority Data

Feb. 20, 2020 (KR) ..... 10-2020-0020928

(51) Int. Cl.
*F24C 7/08* (2006.01)
*G05G 1/10* (2006.01)

(52) U.S. Cl.
CPC ..... *F24C 7/082* (2013.01); *G05G 1/10* (2013.01)

(58) Field of Classification Search
CPC .... G05G 1/10; B60K 37/06; B60K 2370/126; F16C 7/082; G06F 3/0362; F24C 3/126
See application file for complete search history.

(56) References Cited

U.S. PATENT DOCUMENTS

| | | | | |
|---|---|---|---|---|
| 2,005,792 A | | 6/1935 | Leins | |
| 2,738,758 A | | 9/1953 | Cutler et al. | |
| 3,301,212 A | | 1/1967 | Foster et al. | |
| 4,197,765 A | * | 4/1980 | Shimoda | G05G 1/10 116/309 |
| 5,931,150 A | | 8/1999 | Bowen et al. | |
| 10,276,316 B2 | | 4/2019 | Turner et al. | |
| 2010/0264344 A1 | | 10/2010 | Shaffer et al. | |
| 2016/0097541 A1 | * | 4/2016 | Choi | G05G 1/08 126/39 N |
| 2016/0265786 A1 | * | 9/2016 | Choi | F24C 3/124 |
| 2017/0227231 A1 | * | 8/2017 | Pionek | F24C 3/124 |
| 2019/0051468 A1 | * | 2/2019 | Turner | F24C 3/126 |

FOREIGN PATENT DOCUMENTS

| | | | | |
|---|---|---|---|---|
| EP | 3869104 A1 | * | 8/2021 | F24C 7/08 |
| JP | H07-119985 A | | 5/1995 | |
| KR | 10-2004-0009892 A | | 1/2004 | |
| KR | 10 2018 0095438 A | | 8/2018 | |
| WO | WO 2014016114 A2 | * | 1/2014 | |
| WO | WO 2018054801 A1 | * | 3/2018 | |

* cited by examiner

*Primary Examiner* — Vinh Luong

(74) *Attorney, Agent, or Firm* — Dentons US LLP

(57) ABSTRACT

A cooking appliance includes a shaft protruding to an outside of a control panel; a knob installed in a way that encircles an outside of the shaft protruding to the outside of the control panel; a knob ring disposed between the control panel and the knob, and configured to guide a rotation of the knob; a supporter disposed between the knob and the knob ring, and shaft-coupled to the shaft to connect the knob and the shaft; and a support part disposed between the knob ring and the supporter and configured to narrow a gap between the knob ring and the supporter, or disposed between the knob ring and the knob and configured to narrow a gap between the knob ring and the knob.

18 Claims, 11 Drawing Sheets

COOKING APPLIANCE

CROSS-REFERENCE TO RELATED APPLICATION

This application claims priority to and the benefit of Korean Patent Application No. 10-2020-0020928, filed in Korea on Feb. 20, 2020, the disclosure of which is incorporated herein by reference in its entirety.

FIELD

Disclosed herein is a cooking appliance, and more particularly, a cooking appliance provided with an operation part for controlling functions of the cooking appliance.

BACKGROUND

Various types of cooking appliances are used to heat food at homes or restaurants. The cooking appliances include cooktops or ovens and the like, for example.

The cooktops can heat a cooking vessel using gas or electricity. Electric cooktops are broadly classified as a resistance heating-type one and an induction heating-type one. When it comes to a resistance heating method, heat is generated when electric current flows through a metallic resistance wire or through a non-metallic heat generation element such as silicon carbide, and the generated heat is radiated or conducted to heat a cooking vessel. When it comes to an induction heating method, a magnetic field is generated around a coil when high-frequency power is supplied to a coil, and eddy current produced in the generated magnetic field is used to heat a cooking vessel made of a metallic material.

The ovens are home appliances that heat and cook food. Particularly, electric ovens are provided with a cooking space that is optionally opened and closed by a door, and include electric components for generating microwaves or a heating part such as a heater for generating heat. Food in the cooking space can be heated and cooked by microwaves generated by the electric components or heat generated by the heater.

A cooking appliance such as an oven includes an operation part such as a knob. Operations of the cooking appliance are controlled by turning the operation part.

The operation part is rotated while shaking when a user turns the operation part, thereby causing a reduction in the operability and the quality of operation sensitivity. Thus, there is a growing need for a solution to the problem.

SUMMARY

Technical Problem

The present disclosure is directed to a cooking appliance that may reduce a shake of an operation part as much as possible when a user rotates the operation part.

The present disclosure is also directed to a cooking appliance that may prevent damage to a shaft, caused by an external impact delivered to the shaft connected to a knob.

Aspects are not limited to the above ones, and other aspects and advantages that are not mentioned above can be clearly understood from the following description and can be more clearly understood from the embodiments set forth herein. Further, the aspects and advantages can be realized via means and combinations thereof in the appended claims.

Technical Solution

A cooking appliance according to embodiments may include a first support part protruding from a supporter toward a knob ring, and a second support part protruding from the knob ring toward the first support part, thereby reducing a shake of an operation part as much as possible.

For the cooking appliance, the first support part and the second support part may be disposed outside a shaft, thereby protecting the shaft from an external impact.

The cooking appliance may include a third support part protruding from an edge of a knob facing the knob ring toward the knob ring, thereby reducing a shake of the operation part as much as possible.

For the cooking appliance, the third support part may be disposed outside the shaft, thereby protecting the shaft from an external impact.

The cooking appliance may include a fourth support part protruding from the knob ring facing the edge of the knob toward the knob, thereby reducing a shake of the operation part as much as possible.

For the cooking appliance, the fourth support part may be disposed outside the shaft, thereby protecting the shaft from an external impact.

A cooking appliance according to the present disclosure may include a shaft protruding to an outside of a control panel, a knob installed in a way that encircles an outside of the shaft protruding to the outside of the control panel, a knob ring disposed between the control panel and the knob and configured to guide a rotation of the knob, a supporter disposed between the knob and the knob ring and shaft-coupled to the shaft to connect the knob and the shaft, and a support part disposed between the knob ring and the supporter and configured to narrow a gap between the knob ring and the supporter or disposed between the knob ring and the knob and configured to narrow a gap between the knob ring and the knob.

The support part may protrude from the knob ring toward the knob, or may protrude from the supporter or the knob toward the knob ring.

Additionally, the support part may include a first support part protruding from the supporter toward the knob ring.

The first support part may be disposed outside the shaft and may protrude from the supporter in a plate shape.

A plurality of first support parts may be disposed along a circumference that has the shaft as a center.

The plurality of first support parts may be spaced apart at a predetermined angle.

The support part may further include a second support part protruding from the knob ring toward the first support part.

A space may be formed between the first support part and the second support part.

The second support part may be installed in a way that encircles the supporter disposed outside the shaft.

The support part may include a third support part protruding from an edge of the knob facing the knob ring toward the knob ring.

Additionally, the support part may include a fourth support part protruding from the knob ring toward the knob, and configured to support the knob installed at a slant with respect to the shaft.

The fourth support part may be disposed outside the shaft, and installed along a circular arc that has the shaft as a center.

Additionally, the fourth support part may be installed at a position facing the edge of the knob in a ring shape.

Further, the fourth support part may be installed at the knob ring facing the edge of the knob in the form of a plurality of projections.

Furthermore, the fourth support part may be formed into a projection having a hemisphere-shaped cross section.

The supporter may include a shaft coupler installed in a way that encircles an end of the shaft, a skirt configured to contact an inner circumferential surface of the knob, and a coupler configured to connect the shaft coupler and the skirt and coupled to the knob.

Additionally, the supporter may further include a support projection disposed between the shaft coupler and the skirt, and protruding from the coupler toward the knob ring.

The support projection may be installed in a way that passes through the knob ring, and may be fitting-coupled to an inside of the knob ring.

Additionally, the support part may include a first support part protruding from the coupler disposed outside the support projection toward the knob ring.

A plurality of first support parts may be installed around the shaft along a circumferential direction, and may protrude in a plate shape.

The first support parts may be installed radially around the shaft.

Advantageous Effect

A cooking appliance according to the present disclosure may prevent a knob from tilting at a predetermined angle or greater as a first support part contacts a second support part when the knob rotating tilts, thereby improving operational reliability of the knob.

Additionally, when the knob rotating tilts, a third support part may contact a knob ring and prevent the knob from tilting at the predetermined angle or greater, thereby improving operational reliability of the knob.

Further, when the knob rotating tilts, a fourth support part may contact the knob and may prevent the knob from tilting at the predetermined angle or greater, thereby improving operational reliability of the knob.

Furthermore, since a support part is disposed outside a shaft, the support part may absorb an external impact, thereby protecting the shaft from the external impact and improving durability of the shaft.

Specific effects are described together with the above-described effects in the section of Detailed Description.

BRIEF DESCRIPTION OF DRAWING

The accompanying drawings constitute a part of this specification, illustrate one or more embodiments of the present disclosure, and together with the specification, explain the present disclosure, wherein.

DETAILED DESCRIPTION

Figure 1:
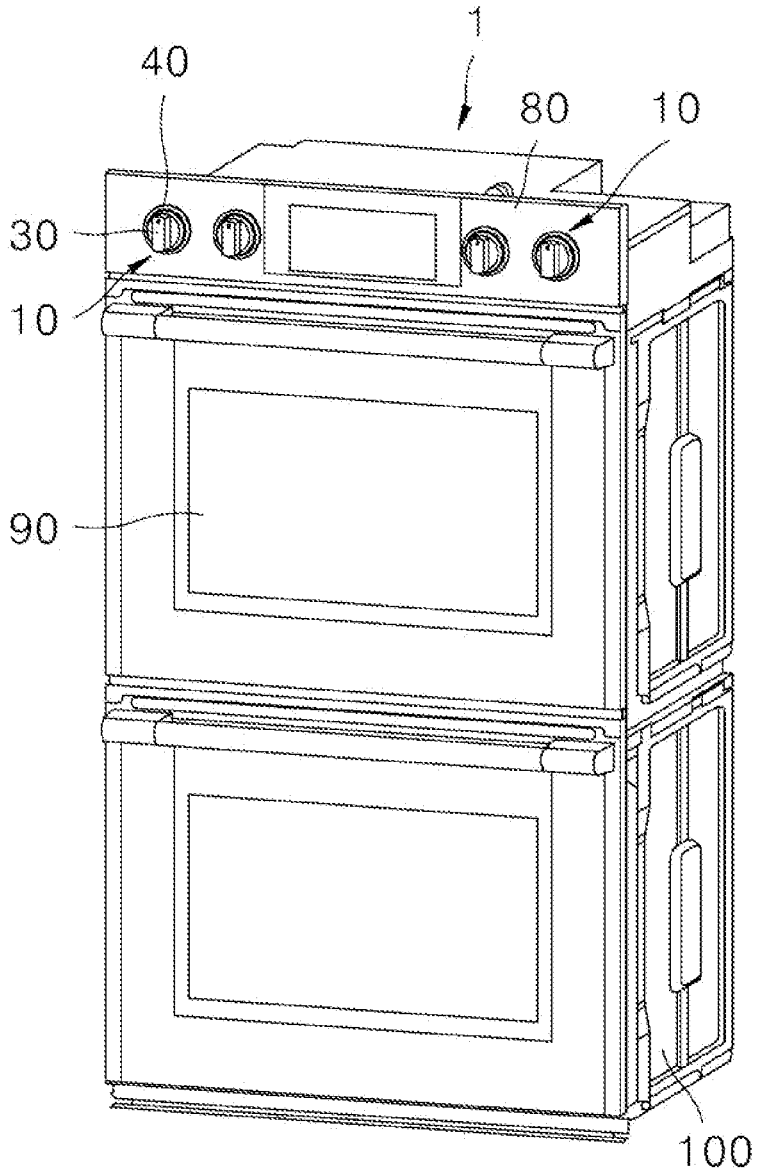
FIG. 1 is a perspective view showing an exterior of a cooking appliance according to a first embodiment.

The above-described aspects, features and advantages are specifically described hereunder with reference to the accompanying drawings such that one having ordinary skill in the art to which the present disclosure pertains can easily implement the technical spirit in the disclosure. In the disclosure, detailed description of known technologies in relation to the disclosure is omitted if it is deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

When one component is described as being "in an upper portion (or a lower portion)" of another component, or "on (or under)" another component, one component may be placed on the upper surface (or under the lower surface) of another component, and an additional component may be interposed between another component and one component on (or under) another component.

When one component is described as being "connected", "coupled", or "connected" to another component, one component can be directly connected, coupled or connected to another component; however, it is also to be understood that an additional component can be "interposed" between the two components, or the two components can be "connected", "coupled", or "connected" through an additional component.

Throughout the disclosure, each component can be provided as a single one or a plurality of ones, unless explicitly stated to the contrary.

The singular forms "a", "an" and "the" are intended to include the plural forms as well, unless explicitly indicated otherwise. It should be further understood that the terms "comprise" or "have," set forth herein, are not interpreted as necessarily including all the stated components or steps but can be interpreted as including some of the stated components or steps or can be interpreted as further including additional components or steps.

Throughout the disclosure, the terms "A and/or B" as used herein can denote A, B or A and B, and the terms "C to D"

can denote C or greater and D or less, unless stated to the contrary (optionally chosen depending on technical fields).

Below, a cooking appliance according to several embodiments is described.

Details in the present disclosure may be applied to all types of cooking appliances that heat an object to be heated using gas or electricity. The cooking appliance according to the disclosure may include a cooktop that heats a cooking vessel using gas or electricity, an oven or a microwave oven that heats and cooks food using gas or electricity, and the like.

For convenience, an electric oven is described as an example of the cooking appliance during description of embodiments. However, embodiments are not limited to those set forth herein.

Figure 1A:
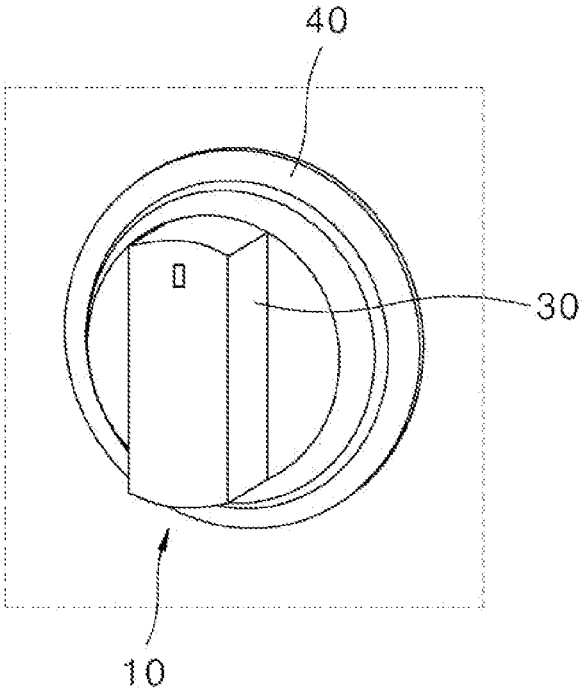
FIG. 1A is an enlarged perspective view showing an exterior of an operation part according to a first embodiment.
Figure 2:
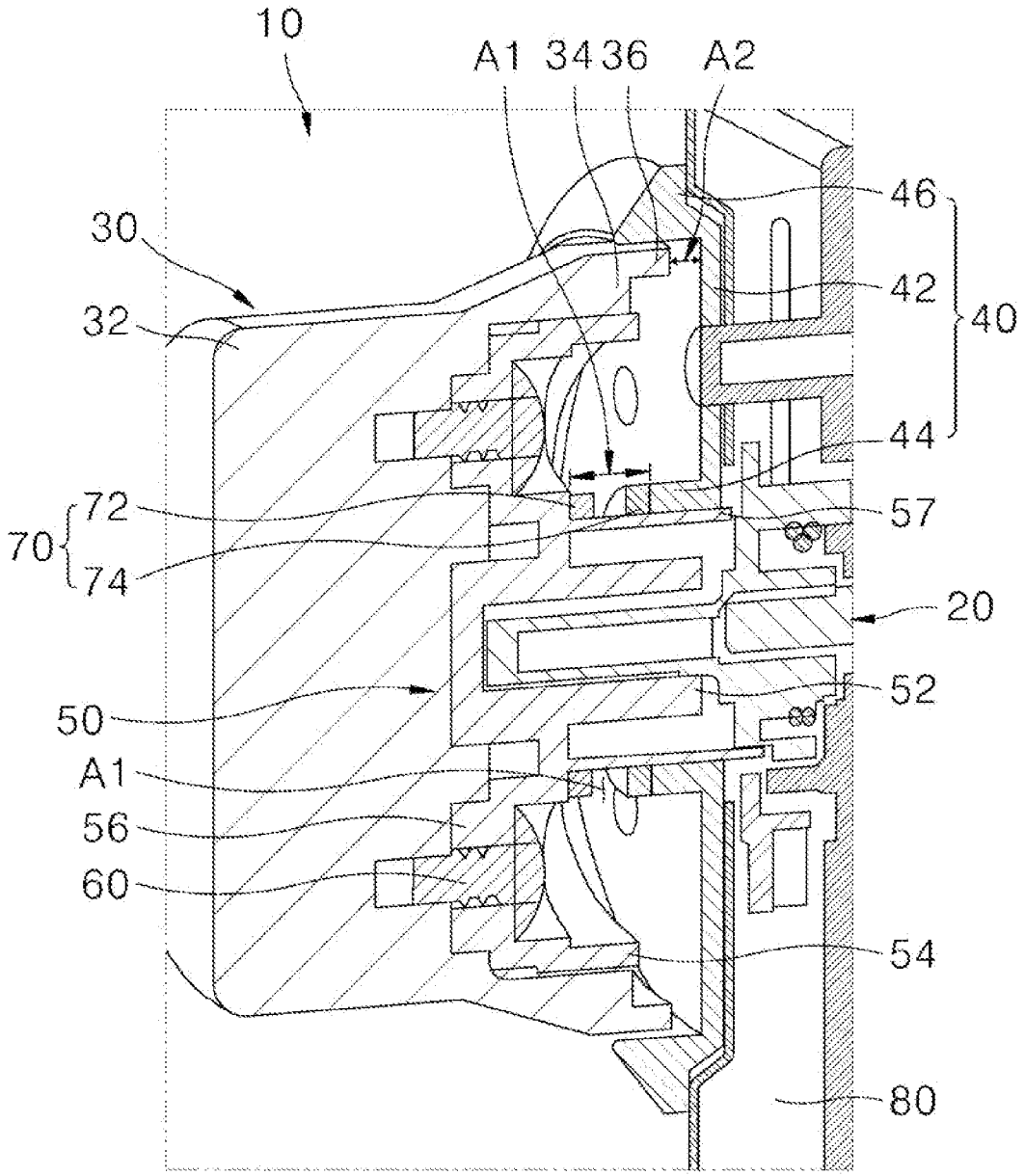
FIG. 2 is a perspective view showing a cross section of an operation part, a supporter, a support part, and a knob ring body according to the first embodiment.
Figure 3:
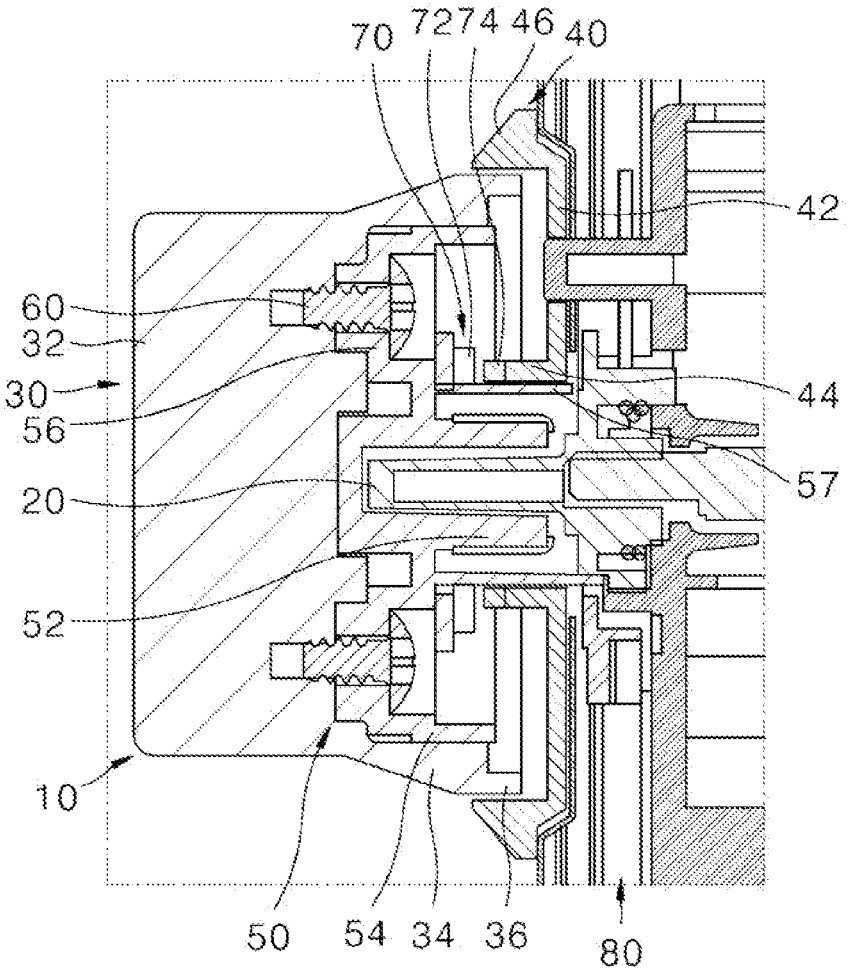
FIG. 3 is a cross-sectional view showing the operation part, the supporter, the support part, and the knob ring body according to the first embodiment.

FIG. 1 is a perspective view showing an exterior of a cooking appliance 1 according to a first embodiment, FIG. 1A is an enlarged perspective view showing an exterior of an operation part according to a first embodiment, FIG. 2 is a perspective view showing a cross section of an operation part 10 according to the first embodiment, and FIG. 3 is a cross-sectional view showing the operation part 10 according to the first embodiment.

Referring to FIGS. 1 to 3, the cooking appliance 1 may include an operation part 10, a control panel 80, a door 90, and a case 100.

The case 100 may have an inner space for accommodating and heating food. The case 100 may be provided with parts such as a heater for heating food accommodated in the inner space, a cooling fan and the like. The case 100 may have a shape a front of which is open.

The door 90 may be installed on a front surface of the case 100 in a rotatable manner, and may open the front of the case 100 as a result of a rotating movement.

The operation part 10 may be implemented in many different forms within the scope of the technology by which the operation part 10 receives an operation signal for controlling a device. The operation part 10 according to the first embodiment may be installed outside the control panel 80 fixed to the case 100.

The operation part 10 may be rotatably installed at a front of the control panel 80. The operation part 10 may make a rotating movement to receive an operation signal, and when necessary, may make forward and backward movements.

The operation part 10 may be provided with a support part 70 to prevent a shake that is caused when the operation part 10 operates. When a knob 30 included in the operation part 10 shakes in a left-right direction, the support part 70 may cause friction, and the knob 30 may be prevented from tilting at a predetermined angle or greater. Accordingly, a shake of the knob 30 may be prevented.

The operation part 10 according to the first embodiment may include a shaft 20, a knob 30, a knob ring 40, a supporter 50 and a support part 70.

The shaft 20 may be implemented in many different forms within the scope of the technology by which the shaft 20 protrudes to an outside of the control panel 80. The shaft 20 according to the first embodiment may be installed in a way that passes through the control panel 80. The shaft 20 may have a rod shape, and may be a rotating body a shape of which is modified in many different forms when necessary.

The knob 30 may be implemented in many different forms within the scope of the technology by which the knob 30 is installed in a way that encircles an outside of the shaft 20 protruding to the outside of the control panel 80. Additionally, the knob 30 may be formed using at least one of metal and an injection mold, and may be a component directly contacted by a user such that the user operates the cooking appliance 1. The knob 30 may be coupled to the supporter 50 and installed in the way that encircles the shaft 20. The knob 30 according to the first embodiment may include a knob body 32, a knob edge 34, and a knob projection 36.

The knob body 32 may be coupled to the supporter 50 and installed at a position facing the knob ring 40. The knob body 32 according to the first embodiment may be disposed at a front of the shaft 20 and may have a cylindrical shape.

The knob edge 34 may extend from an edge of the knob body 32 toward the control panel 80. The knob edge 34 according to the first embodiment may have a pipe shape and may encircle the supporter 50 and extend toward the knob ring 40.

The knob projection 36 may have a projection shape and protrude from an end of the knob edge 34 toward the knob ring 40. The knob projection 36 according to the first embodiment may be installed at the knob edge 34 facing the knob ring 40 in a ring shape.

The knob ring 40 may be implemented in many different forms within the scope of the technology by which the knob ring 40 is disposed between the control panel 80 and the knob 30 and guides a rotation of the knob 30. The knob ring 40 according to the first embodiment may include a knob ring body 42, a shaft support part 44, and a side member 46.

The knob ring body 42 may have a plate shape and may be disposed at the front of the control panel 80. The knob ring body 42 may be fixed to the front of the control panel 80, and the shaft 20 may pass through a central portion of the knob ring body 42 to be installed. The knob ring body 42 according to the first embodiment may have a circular plate shape and may include a hollow hole at the central portion where the shaft 20 and the supporter 50 are disposed.

The shaft support part 44 may be implemented in many different forms within the scope of the technology by which the shaft support part 44 protrudes from the knob ring body 42 and is installed in a way that encircles the supporter 50 disposed outside the shaft 20. The shaft support part 44 according to the first embodiment may have a cylindrical pipe shape and may be installed around the hollow hole of the knob ring body 42.

The side member 46 may protrude along an outer perimeter of the knob ring body 42, and may be disposed outside the knob projection 36 to face the knob projection 36. The side member 46 according to the first embodiment may be installed along an outer circumferential surface of the knob ring body 42, may protrude from the knob ring body 42 toward the front of the control panel 80 and may be disposed outside the knob projection 36. The side member 46 may be installed in different shapes including a ring shape.

Figure 4:
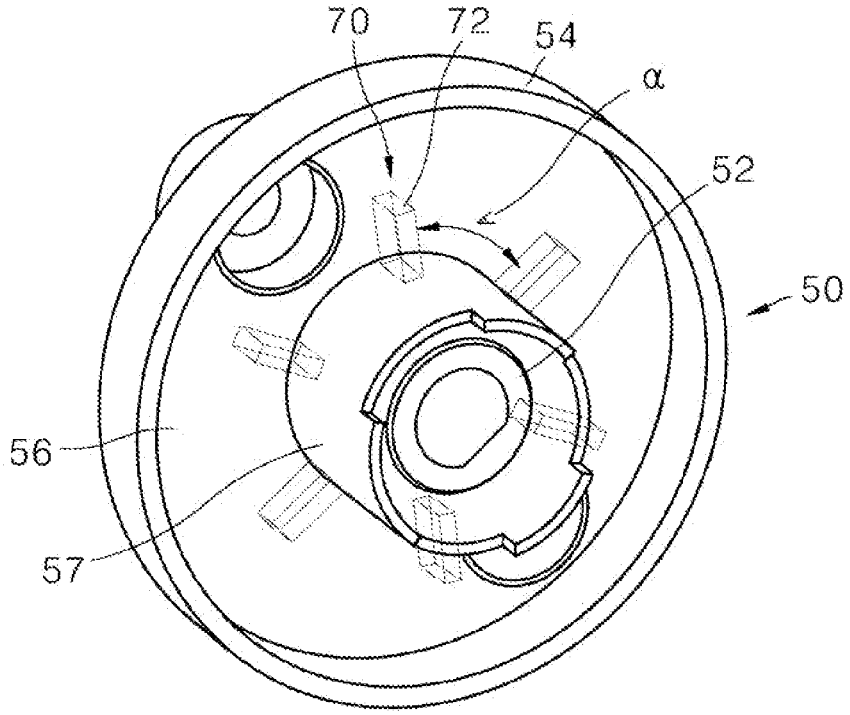
FIG. 4 is a perspective view showing a supporter according to the first embodiment.

FIG. 4 is a perspective view showing a supporter 50 according to the first embodiment.

As illustrated in FIGS. 3 and 4, the supporter 50 may be implemented in many different forms within the scope of the technology by which the supporter 50 is disposed between the knob 30 and the knob ring 40, and is shaft-coupled to the shaft 20 and connects the knob 30 and the shaft 20. The supporter 50 may be primarily coupled to the knob 30, and an inside of the supporter 50 may be connected to the shaft 20 that is installed in the way that passes through the control panel 80. Accordingly, as the shaft 20 may rotate through the knob 30, an operational force may be delivered to the control panel 80.

The supporter 50 according to the first embodiment may include a shaft coupler 52, a skirt 54, a coupler 56 and a support projection 57.

The shaft coupler 52 may be installed in a way that encircles an end of the shaft 20. The shaft coupler 52 according to the first embodiment may have a pipe shape and encircle the end of the shaft 20, and may be disposed inside the shaft support part 44. A front of the shaft coupler 52 may be closed.

The skirt 54 may be implemented in many different forms within the scope of the technology by which the skirt 54 contacts an inner circumferential surface of the knob 30. The skirt 54 according to the first embodiment may be installed along a circumference while contacting an inner surface of the knob edge 34.

The coupler 56 may be implemented in many different forms within the scope of the technology by which the coupler 56 connects the shaft coupler 52 and the skirt 54 and is coupled to the knob 30. The coupler 56 according to the first embodiment may be fixed to an inside of the knob body 32. Since a coupling member 60 is coupled to the coupler 56 while passing through the coupler 56 in a state where the coupler 56 is disposed inside the knob body 32, the coupler 56 may be fixed to the inside of the knob body 32.

The support projection 57 may be implemented in many different forms within the scope of the technology by which the support projection 57 is disposed between the shaft coupler 52 and the skirt 54 and protrudes from the coupler 56 toward the knob ring 40. The support projection 57 according to the first embodiment may be installed in a way that passes through the knob ring 40 and may be fitting-coupled to an inside of the knob ring 40. Additionally, the support projection 57 may be disposed outside the shaft coupler 52 and installed a cylindrical shape.

One side of the support projection 57 may be connected to the coupler 56, and the other side of the support projection 57 may pass through the shaft support part 44 and then may be installed in a way that faces the control panel 80 or the shaft 20. The cylinder-shaped support projection 57 may be disposed inside the shaft support part 44 having a cylinder shape.

The support part 70 may be disposed between the knob ring 40 and the supporter 50, and may narrow or fill in a first gap A1 between the knob ring 40 and the supporter 50. Alternatively, the support part 70 may be implemented in many different forms within the scope of the technology by which the support part 70 is disposed between the knob ring 40 and the knob 30 and narrows or fills in a second gap A2 between the knob ring 40 and the knob 30. Additionally, the support part 70 may protrude from the knob ring 40 toward the knob 30, or may protrude from the supporter 50 or the knob 30 toward the knob ring 40.

When the knob 30 shakes in a left-right direction, friction caused by contact between the support part 70 and the knob ring 40 may prevent the knob 30 from tiling at a predetermined angle or greater. The support part 70 may be installed between the knob 30 and the knob ring 40.

A first support part 72 may be implemented in many different forms within the scope of the technology by which the first support part 72 protrudes from the supporter 50 toward the knob ring 40. The support part 70 according to the first embodiment may include a first support part 72 protruding from the coupler 56, disposed outside the support projection 75, toward the knob ring 40.

The first support part 72 may protrude from the supporter 50 toward the knob ring 40. Additionally, the first support part 72 may be disposed outside the shaft 20 and may protrude from the supporter 50 in a plate shape. A plurality of first support parts 72 may be installed along a circumference that has the shaft 20 as a center. The first support parts 72 may be radially installed around the shaft 20, and may be spaced apart at a predetermined angle.

The first support part 72 according to the first embodiment may be disposed outside the support projection 57 and installed radially around the support projection 57. The first support part 72 protruding outward from the support projection 57 may be connected to the coupler 56, and when necessary, may be connected only to the support projection 57. Alternatively, the first support part 72 may protrude from the coupler 56 toward the knob ring 40, and when necessary, may be connected to the support projection 57.

The first support part 72 may protrude from the supporter 50 toward the knob ring 40. Additionally, the first support part 72 may be disposed outside the shaft 20 and may protrude from the supporter 50 in a plate shape. A plurality of first support parts 72 may be installed along a circumference that has the shaft 20 as a center. The first support parts 72 may be radially installed around the shaft 20, and may be spaced apart at a a predetermined angle $\alpha$.

The support part 70 may further include a second support part 74. The second support part 74 may protrude from the knob ring 40 toward the first support part 72 and contact the first support part 72 tilted along with the knob 30. The second support part 74 may be implemented in many different forms within the scope of the technology by which the second support part 74 reduces a shake of the knob 30 as much as possible by contacting the first support part 72.

A space may be formed between the first support part 72 and the second support part 74 according to the first embodiment. In a state where the knob 30 is not tilted, the space between the first support part 72 and the second support part 74 may help the knob 30 to rotate easily.

The second support part 74 may be installed in a way that encircles the supporter 50 disposed outside the shaft 20. The second support part 74 according to the first embodiment may extend from the shaft support part 44 toward the coupler 56. The second support part 74 may be installed in a pipe shape and may encircle an outside of the support projection 57, and an end of the second support part 74 may be installed in a way that faces an end of the first support part 72.

Since the first support part 72 and the second support part 74 are disposed outside the shaft 20, the first support part 72 and the second support part 74 may protect the shaft 20 from an external impact.

When necessary, the cooking appliance 1 may be provided with the first support part 72 other than the second support part 74. In this case, the first support part 72 may extend toward the shaft support part 44, and a gap having a predetermined width may be formed between the first support part 72 and the shaft support part 44.

Alternatively, the cooking appliance 1 may be provided with the second support part 74 other than the first support part 72. In this case, the second support part 74 may extend toward the coupler 56 of the supporter 50 and a gap having a predetermined width may be formed between the second support part 74 and the coupler 56.

An operation state of a cooking appliance 1 according to one embodiment is described with reference to the accompanying drawings, hereunder.

When a knob 30, configured to receive an operational force for operating the coking appliance 1, rotates, a supporter 50 connected to the knob 30 may also rotate. As a result of the rotation of the supporter 50, a shaft 20 connected to the supporter 50 may rotate. Accordingly, a control panel 80 may receive an operation signal.

In case the knob 30 tilts with respect to the shaft 20 when the knob 30 rotates, a first support part 72 moving along with the knob 30 may contact a second support part 74 fixed to a knob ring 40. Accordingly, the knob 30 and the first support part 72 may be prevented from tilting at the predetermined angle or greater. As a result, a shake that is caused when the knob 30 rotates may be prevented.

Additionally, when the knob 30 moves in a left-right direction, a support projection 57 may constrain the shake of the knob 30 while contacting a shaft support part 44. Accordingly, the left-right movement of the knob 30 may be primarily hampered. Additionally, since the first support part 72 contacts the second support part 74, the left-right movement of the knob 30 may be secondarily hampered.

The cooking appliance 1 according to the first embodiment may reduce a shake, which is caused when the knob 30 is rotated, as much as possible, thereby ensuring improvement in the operability and in the quality of operation sensitivity. Additionally, when a side portion of the knob 30 is affected by an abnormal impact, the first support part 72 and the second support part 74 may absorb some of the impact and prevent damage to the shaft 20.

A cooking appliance 1 according to a second embodiment is described with reference to the drawings, hereunder.

For convenience of description, components having the same configurations and operations as those of the first embodiment are given the same reference numerals, and specific description in relation to the components is omitted.

Figure 5:
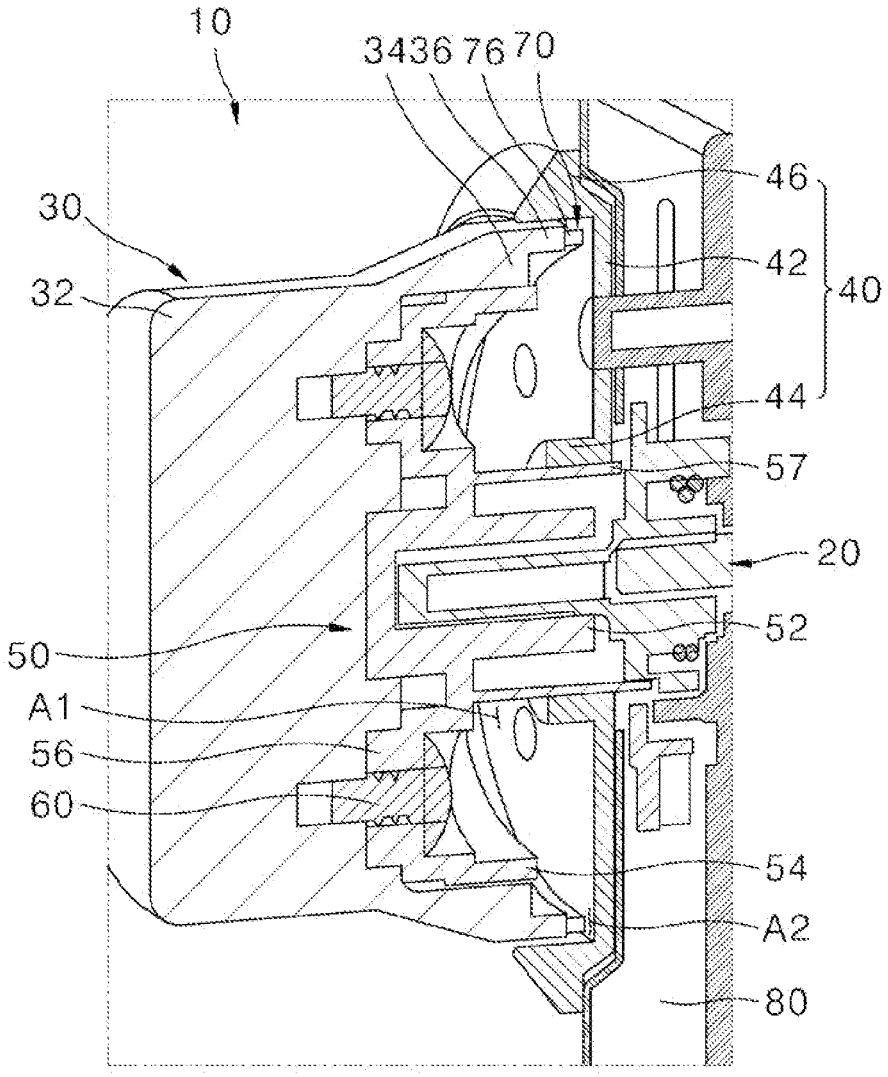
FIG. 5 is a perspective view showing a cross section of an operation part, a supporter, a support part, and a knob ring body according to a second embodiment.
Figure 6:
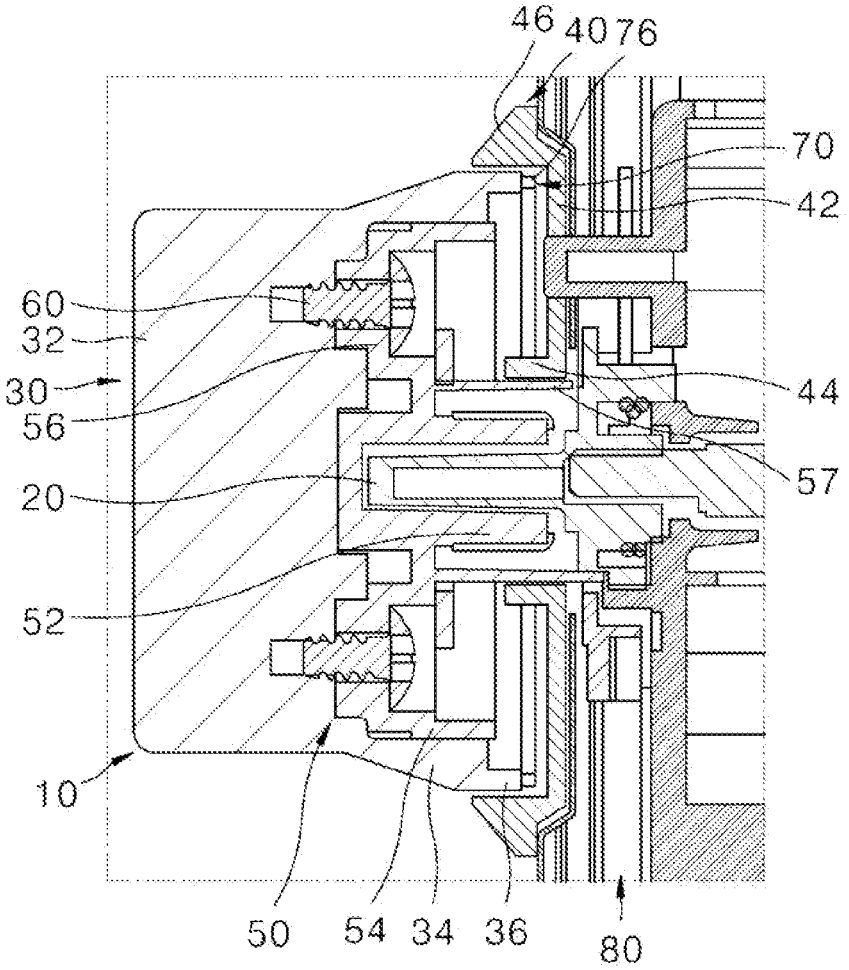
FIG. 6 is a cross-sectional view showing the operation part, the supporter, the support part, and the knob ring body according to the second embodiment.

FIG. 5 is a perspective view showing a cross section of an operation part 10 according to a second embodiment, and FIG. 6 is a cross-sectional view showing the operation part 10 according to the second embodiment.

As shown in FIGS. 5 and 6, a support part 70 of the cooking appliance 1 according to the second embodiment may be provided with a third support part 76 protruding from an edge of a knob 30 facing a knob ring 40 toward the knob ring 40. Accordingly, a shake of the operation part 10 may be reduced as much as possible.

The third support part 76 may be implemented in many different forms within the scope of the technology by which the third support part 76 protrudes from the edge of the knob 30 facing the knob ring 40 toward the knob ring 40. The third support part 76 according to the second embodiment may be a projection protruding from a knob projection 36 included in the knob 30 toward the knob ring 40, and may be installed on a surface facing an inner surface of a side member 46. Additionally, the third support part 76 may be spaced a predetermined distance apart from a knob ring body 42.

The third support part 76 according to the second embodiment may be installed at an end of the knob projection 36 in a ring shape. Further, the third support part 76 may be installed outside a shaft 20 and may protect the shaft 20 from an external impact.

When the knob 30 tilts while rotating, the third support part 76 moving along with the knob 30 may contact the knob ring body 42 or the side member 46 that are included in the knob ring 40. Accordingly, the knob 30 may be prevented from tilting at a predetermined angle or greater. Thus, a shake that is caused when the knob 30 rotates may be prevented.

Further, since a support projection 57 constrains a shake of the knob 30 while contacting a shaft support part 44 when the knob 30 moves in a left-right direction, the left-right movement of the knob 30 may be primarily hampered, and since the third support part 76 contacts the knob ring 40, may be secondarily hampered.

The cooking appliance 1 according to the second embodiment may reduce a shake, which is caused when the knob 30 is rotated, as much as possible, thereby ensuring improvement in the operability and in the quality of operation sensitivity. Additionally, when a side portion of the knob 30 is affected by an abnormal impact, the third support part 76 may absorb some of the impact and prevent damage to the shaft 20.

A cooking appliance 1 according to a third embodiment is described with reference to the drawings, hereunder.

For convenience of description, components having the same configurations and operations as those of the first embodiment are given the same reference numerals, and specific description in relation to the components is omitted.

Figure 7:
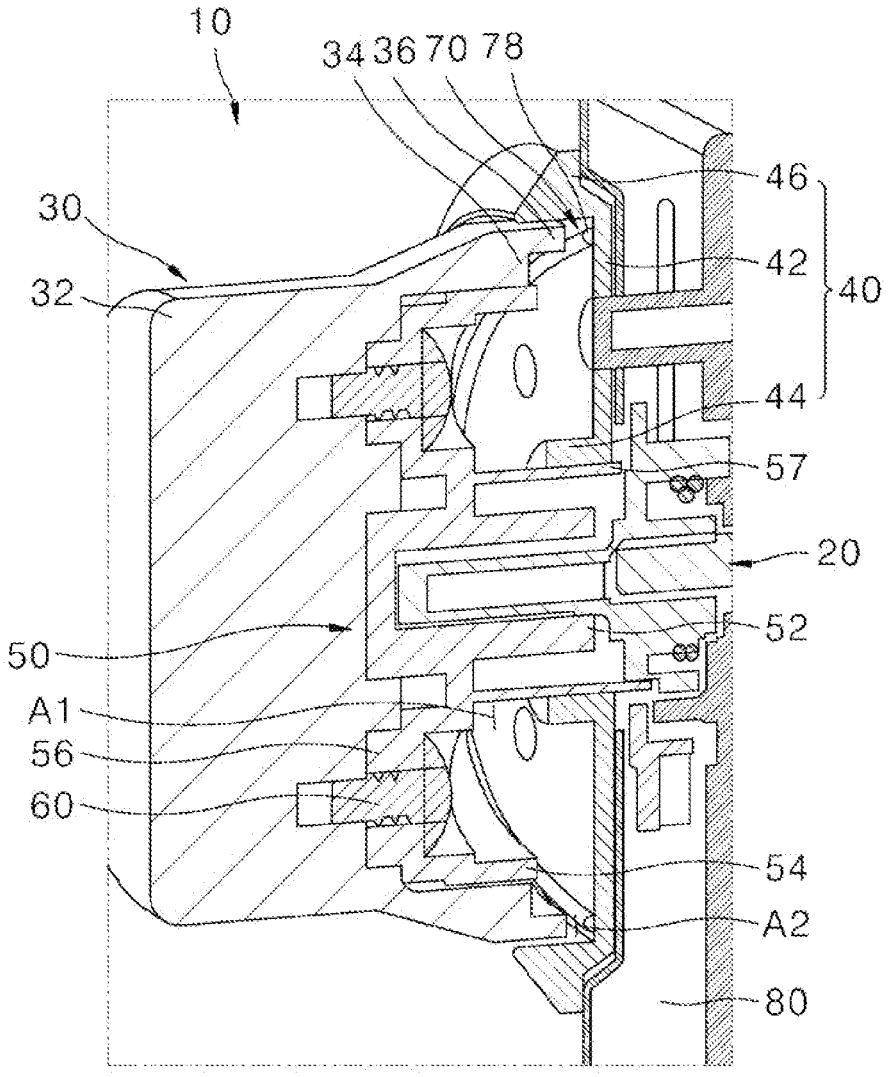
FIG. 7 is a perspective view showing a cross section of an operation part, a supporter, a support part, and a knob ring body according to a third embodiment.
Figure 8:
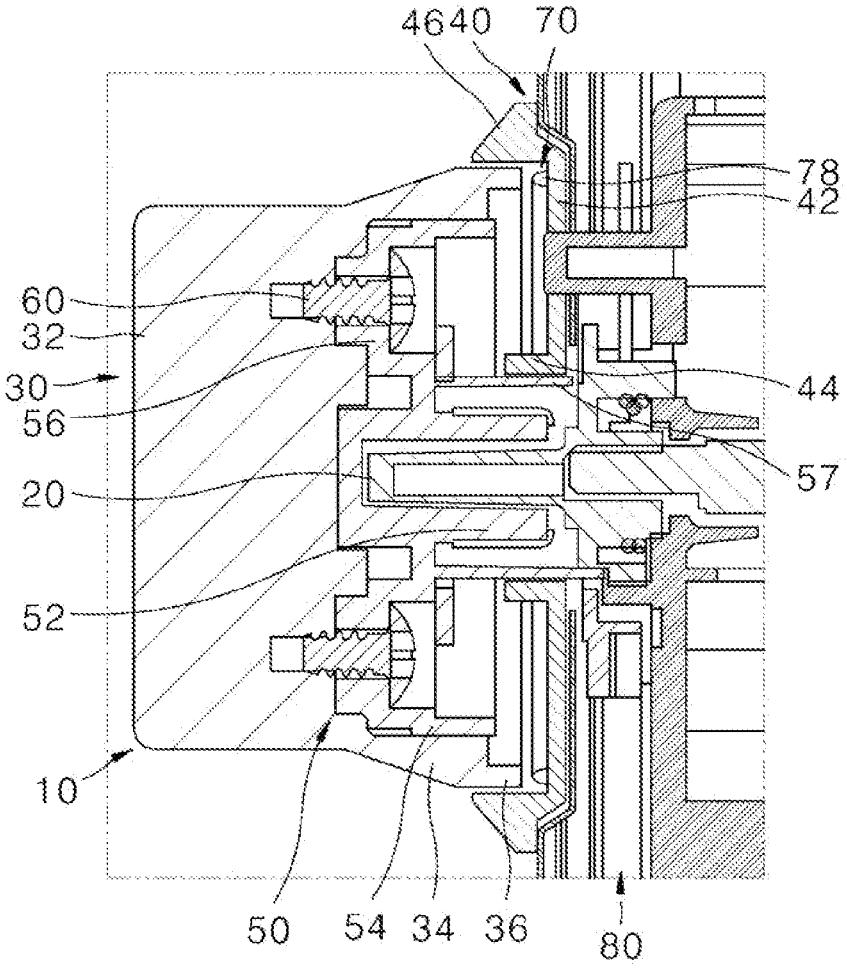
FIG. 8 is a cross-sectional view showing the operation part, the supporter, the support part, and the knob ring body according to the third embodiment.

FIG. 7 is a perspective view showing a cross section of an operation part 10 according to a third embodiment, and FIG. 8 is a cross-sectional view showing the operational part 10 according to the third embodiment.

As shown in FIGS. 7 and 8, a cooking appliance 1 according to the third embodiment may be provided with a fourth support part 78 protruding from a knob ring 40 facing an edge of a knob 30 toward the knob 30, thereby reducing a shake of the operation part 10 as much as possible.

The fourth support part 78 may be implemented in many different forms within the scope of the technology by which the fourth support part 78 protrudes from the knob ring 40 toward the knob 30 and supports the knob 30 installed at a slant with respect to a shaft 20. The fourth support part 78 may be disposed outside the shaft 20 and installed along a circular arc which has the shaft 20 as a center.

The fourth support part 78 according to the third embodiment may be installed at a position facing an edge of the knob 30 in a ring shape. The fourth support part 78 protruding from a knob ring body 42 facing a knob projection 36 toward the knob projection 36 may be installed in a ring shape, and may be spaced a predetermined distance apart from the knob projection 36. Additionally, since the fourth support part 78 is disposed outside the shaft 20, the fourth support part 78 may protect the shaft 20 from an external impact.

When the knob 30 tilts while rotating, the knob projection 36 included in the knob 30 may contact the fourth support part 78 fixed. Accordingly, the knob 30 may be prevented from tilting at a predetermined angle or greater. Thus, a shake that is caused when the knob 30 rotates may be prevented.

Further, since a support projection 57 constrains a shake of the knob 30 while contacting a shaft support part 44 when the knob 30 moves in a left-right direction, the left-right movement of the knob 30 may be primarily hampered, and since the fourth support part 78 contacts the knob 30, may be secondarily hampered.

The cooking appliance 1 according to the third embodiment may reduce a shake, which is caused when the knob 30 is rotated, as much as possible, thereby ensuring improvement in the operability and in the quality of operation sensitivity. Additionally, when a side portion of the knob 30 is affected by an abnormal impact, the fourth support part 78 may absorb some of the impact and prevent damage to the shaft 20.

A cooking appliance 1 according to a fourth embodiment is described with reference to the drawings, hereunder.

For convenience of description, components having the same configurations and operations as those of the first embodiment are given the same reference numerals, and specific description in relation to the components is omitted.

Figure 9:
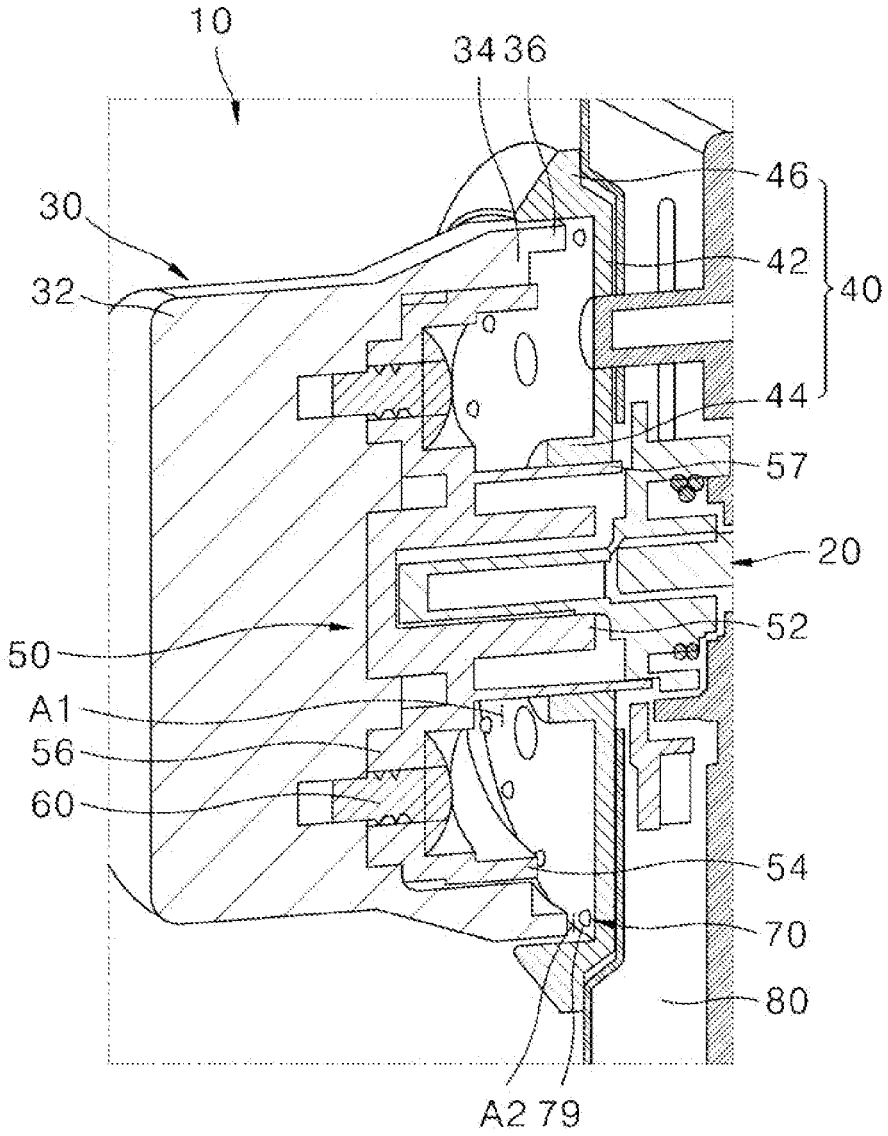
FIG. 9 is a perspective view showing a cross section of an operation part, a supporter, a support part, and a knob ring body according to a fourth embodiment.
Figure 10:
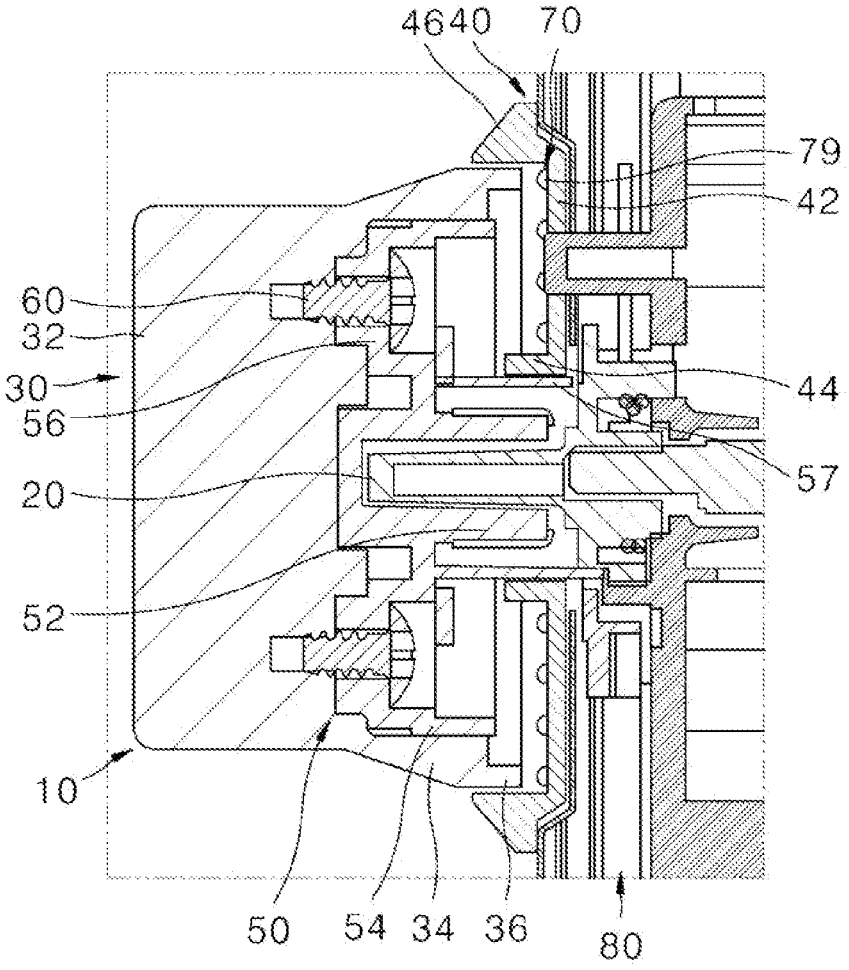
FIG. 10 is a cross-sectional view showing the operation part, the supporter, the support part, and the knob ring body according to the fourth embodiment.

FIG. 9 is a perspective view showing a cross section of an operation part 10 according to a fourth embodiment, and FIG. 10 is a cross-sectional view showing the operation part 10 according to the fourth embodiment.

As shown in FIGS. 9 and 10, a cooking appliance 1 according to the fourth embodiment may be provided with a fourth support part 79 protruding from a knob ring 40 facing an edge of a knob 30 toward the knob 30, thereby reducing a shake of the operation part 10 as much as possible.

The fourth support part 79 according to the fourth embodiment may protrude from a knob ring body 42 facing a knob projection 36 toward the knob projection 36. A plurality of knob projections 36 may be disposed in a ring shape and spaced a predetermined distance apart.

The fourth support part 79 may be a projection having a hemisphere shaped-cross section and may protrude from the knob ring 40 toward the knob 30. The fourth support part 79 may be implemented in many different forms with the scope of the technology by which the fourth support part 79 supports the knob 30 installed at a slant with respect to a shaft 20. The fourth support part 79 may be disposed outside the shaft 20 and may be installed along a circular arc that has the shaft 20 as the center.

The fourth support part 79 according to the fourth embodiment may be a hemisphere-shaped projection and may be installed at a position facing an edge of the knob 30.

The fourth support part 79 protruding from the knob ring body 42 facing the knob projection 36 toward the knob projection 36 may have a projection shape, and may be spaced a predetermined distance apart from the knob projection 36. Since the fourth support part 79 is installed outside the shaft 20, the fourth support part 79 may protect the shaft 20 from an external impact.

When the knob 30 tilts while rotating, the knob projection 36 included in the knob 30 may contact the fourth support part 79 fixed. Accordingly, the knob 30 may be prevented from tilting at a predetermined angle or greater. Thus, a shake that is caused when the knob 30 rotates may be prevented.

Further, since a support projection 57 constrains a shake of the knob 30 while contacting a shaft support part 44 when the knob 30 moves in a left-right direction, the left-right movement of the knob 30 may be primarily hampered, and since the fourth support part 79 contacts the knob 30, may be secondarily hampered.

The cooking appliance 1 according to the fourth embodiment may reduce a shake, which is caused when the knob 30 is rotated, as much as possible, thereby ensuring improvement in the operability and in the quality of operation sensitivity. Additionally, when a side portion of the knob 30 is affected by an abnormal impact, the fourth support part 79 may absorb some of the impact and prevent damage to the shaft 20.

The cooking appliance 1 according to the present disclosure, as described above, may prevent the knob 30 from tilting at a predetermined angle or greater as the first support part 72 contacts the second support part 74 when the knob 30 rotating tilts, thereby improving operational reliability of the knob 30. Additionally, when the knob 30 rotating tilts, the third support part 76 may contact the knob ring 40 and prevent the knob 30 from tilting at the predetermined angle or greater, thereby improving operational reliability of the knob 30. Further, when the knob 30 rotating tilts, the fourth support part 78 may contact the knob 30 and may prevent the knob 30 from tilting at the predetermined angle or greater, thereby improving operational reliability of the knob 30. Furthermore, since the support part 70 is disposed outside the shaft 20, the support part 70 may absorb an external impact, thereby protecting the shaft 20 from the external impact and improving durability of the shaft 20.

The embodiments are described above with reference to a number of illustrative embodiments thereof. However, the present disclosure is not intended to limit the embodiments and drawings set forth herein, and numerous other modifications and embodiments can be devised by one skilled in the art without departing from the technical spirit of the disclosure. Further, the effects and predictable effects based on the configurations in the disclosure are to be included within the range of the disclosure though not explicitly described in the description of the embodiments.

DESCRIPTION OF SYMBOL

1: Cooking appliance
10: Operation part
20: Shaft
30: Knob
32: Knob body
34: Knob edge
36: Knob projection
40: Knob ring
42: Knob ring body
44: Shaft support part
46: Side member
50: Supporter
52: Shaft coupler
54: Skirt
56: Coupler
57: Support projection
60: Coupling member
70: Support part
72: First support part
74: Second support part
76: Third support part
78: Fourth support part
79: Fourth support part
80: Control panel
90: Door
100: Case

What is claimed is:

1. A cooking appliance, comprising:

a shaft protruding to an outside of a control panel;

a knob disposed that encircles an outside of the shaft protruding to the outside of the control panel;

a knob ring disposed between the control panel and the knob, to guide a rotation of the knob;

a supporter disposed between the knob and the knob ring, and coupled to the shaft to connect the knob to the shaft; and a support part disposed between the knob ring and the supporter, to narrow a gap between the knob ring and the supporter, wherein the support part includes a first support part protruding from the supporter toward the knob ring, and wherein a plurality of first support parts are disposed along an outer circumference of the supporter that has the shaft as a center.

2. The cooking appliance of claim 1, wherein the support part protrudes from the knob ring toward the knob, or protrudes from the supporter or the knob toward the knob ring.

3. The cooking appliance of claim 1, wherein the first support part is disposed outside the shaft, and protrudes from the supporter in a plate shape.

4. The cooking appliance of claim 1, wherein the plurality of first support parts are spaced apart at a predetermined angle.

5. The cooking appliance of claim 1, wherein the support part includes a second support part protruding from the knob ring toward the first support part, and a space is formed between the first support part and the second support part.

6. The cooking appliance of claim 5, wherein the second support part is encircles the supporter and is disposed outside the shaft.

7. A cooking appliance, comprising:

a shaft protruding to an outside of a control panel;

a knob disposed that encircles an outside of the shaft protruding to the outside of the control panel;

a knob ring disposed between the control panel and the knob, to guide a rotation of the knob;

a supporter disposed between the knob and the knob ring, and coupled to the shaft to connect the knob to the shaft; and a support part disposed between the knob ring and the knob, to narrow a gap between the knob ring and the knob, wherein the support part includes a support part protruding from an edge of the knob facing the knob ring toward the knob ring.

8. A cooking appliance, comprising:

a shaft protruding to an outside of a control panel;

a knob disposed that encircles an outside of the shaft protruding to the outside of the control panel;

a knob ring disposed between the control panel and the knob, to guide a rotation of the knob;

a supporter disposed between the knob and the knob ring, and coupled to the shaft to connect the knob to the shaft; and a support part disposed between the knob ring and the knob, to narrow a gap between the knob ring and the knob, wherein the support part includes a first support part protruding from the knob ring toward the knob, to support the knob when the knob slants with respect to the shaft.

9. The cooking appliance of claim 8, wherein the first support part is disposed outside the shaft, and disposed along a circular arc that has the shaft as a center.

10. The cooking appliance of claim 8, wherein the supporter comprises:

a shaft coupler disposed that encircles an end of the shaft;

a skirt that contacts an inner circumferential surface of the knob; and a coupler that connects the shaft coupler and the skirt.

11. The cooking appliance of claim 10, wherein the supporter includes a support projection disposed between the shaft coupler and the skirt, and protrudes from the coupler toward the knob ring.

12. The cooking appliance of claim 11, wherein the support projection is disposed that passes through the knob ring, and is coupled to an inside of the knob ring.

13. The cooking appliance of claim 11, wherein the support part includes a second support part protruding from the coupler disposed outside the support projection toward the knob ring.

14. The cooking appliance of claim 13, wherein a plurality of second support parts are disposed around the shaft along a circumferential direction and protrude in a plate shape.

15. The cooking appliance of claim 14, wherein the plurality of second support parts are disposed radially around the shaft.

16. The cooking appliance of claim 9 wherein the first support part is disposed at a position facing an edge of the knob in a ring shape.

17. The cooking appliance of claim 9, wherein the first support part is disposed at the knob ring facing an edge of the knob in the form of a plurality of projections.

18. The cooking appliance of claim 16, wherein the first support part is formed as a projection having a hemisphere-shaped cross section.

* * * * *